US008602252B2

(12) United States Patent
Syrkos

(10) Patent No.: US 8,602,252 B2
(45) Date of Patent: Dec. 10, 2013

(54) LIQUID DISPENSING COVER FOR CONTAINER

(76) Inventor: Yves Syrkos, Blavinville (CA)

( * ) Notice: Subject to any disclaimer, the term of this patent is extended or adjusted under 35 U.S.C. 154(b) by 447 days.

(21) Appl. No.: 12/457,270

(22) Filed: Jun. 5, 2009

(65) Prior Publication Data

US 2010/0059535 A1 Mar. 11, 2010

Related U.S. Application Data

(60) Provisional application No. 61/136,438, filed on Sep. 5, 2008.

(51) Int. Cl.
*B65D 51/18* (2006.01)

(52) U.S. Cl.
USPC ..... 220/711; 220/713; 220/714; 220/254.3; 220/254.4; 220/780

(58) Field of Classification Search
USPC ..... 220/711, 713, 714, 715, 254.5; 229/404, 906.1
See application file for complete search history.

(56) References Cited

U.S. PATENT DOCUMENTS

| | | | | | |
|---|---|---|---|---|---|
| 3,860,162 | A * | 1/1975 | Schutz | 220/711 |
| 3,927,794 | A * | 12/1975 | Erdman | 220/268 |
| 4,113,135 | A * | 9/1978 | Yamazaki | 220/268 |
| 4,184,604 | A * | 1/1980 | Amberg et al. | 220/254.3 |
| 4,190,174 | A * | 2/1980 | Haimowitz | 220/254.6 |
| 4,345,695 | A * | 8/1982 | Galloway et al. | 220/254.6 |
| 4,350,260 | A * | 9/1982 | Prueher | 220/254.3 |
| 4,412,629 | A * | 11/1983 | Dart et al. | 220/711 |
| 4,438,865 | A | 3/1984 | Scattaregia | |
| 4,441,623 | A * | 4/1984 | Antoniak | 220/711 |
| 4,589,569 | A * | 5/1986 | Clements | 220/380 |
| 4,784,283 | A * | 11/1988 | Cantu | 220/269 |
| 4,838,450 | A | 6/1989 | Bocchi | |
| 5,111,961 | A | 5/1992 | Van Melle | |
| 5,147,057 | A | 9/1992 | Marshall et al. | |
| 5,509,568 | A * | 4/1996 | Warden et al. | 220/711 |
| 5,706,972 | A * | 1/1998 | Sousa | 220/714 |
| 5,839,601 | A | 11/1998 | Van Melle | |
| 6,089,397 | A | 7/2000 | Van Melle | |
| 6,419,105 | B1 * | 7/2002 | Bruce et al. | 220/266 |
| 6,612,456 | B1 * | 9/2003 | Hundley et al. | 220/254.3 |
| 7,111,749 | B1 | 9/2006 | Akers | |
| 7,191,911 | B2 | 3/2007 | O'Neill | |
| 2002/0096530 | A1 * | 7/2002 | Waller | 220/713 |
| 2002/0100757 | A1 | 8/2002 | Shih | |
| 2003/0218017 | A1 * | 11/2003 | Schmidtner et al. | 220/254.5 |
| 2004/0178207 | A1 | 9/2004 | Kim | |
| 2005/0051552 | A1 | 3/2005 | Kim | |
| 2007/0199945 | A1 * | 8/2007 | Ho | 220/719 |
| 2007/0199961 | A1 * | 8/2007 | Ho | 222/566 |
| 2008/0000920 | A1 * | 1/2008 | Ho | 220/711 |

* cited by examiner

*Primary Examiner* — Anthony Stashick
*Assistant Examiner* — Chetan Chandra
(74) *Attorney, Agent, or Firm* — Equinox Protection Inc.; Franz Bonsang

(57) ABSTRACT

A liquid dispensing cover for a container has a dispensing recess extending into a cover top thereof. The dispensing recess is resiliently openable and closable to enable placement of cover into a closed configuration, in which the dispensing recess is closed, and an open configuration in which the dispensing recess is open to allow flow of liquid through the dispensing recess for drinking.

10 Claims, 9 Drawing Sheets

LIQUID DISPENSING COVER FOR CONTAINER

CROSS REFERENCE TO RELATED APPLICATION

Benefit of U.S. Provisional Application for Patent Ser. No. 61/136,438 filed on Sep. 5, 2008, is hereby claimed.

FIELD OF THE INVENTION

The present invention relates to covers for containers, and is more directly concerned with a liquid dispensing cover for a container for storing liquid.

BACKGROUND OF THE INVENTION

Use of liquid dispensing covers for liquid containers holding liquids are well known in the art. Such covers often form part of, or are connected or connectable to, containers, for example glasses or cups, for storing liquid for drinking and provide a dispenser through which liquid may pass to be dispensed, for example released or poured, typically into the mouth of a user for drinking of the liquid.

Such dispensers often include spouts, dispensing apertures, or the like through which the liquid may pass. The remainder of the cover sealingly mates or co-operates with the container to sealingly impede spillage or escape of the liquid therefrom. For example, such covers may often be connected to a rim or top end of the container which defines a container aperture for the container. In such cases, the cover sealingly engages the container top end and covers the container aperture to impede escape or release of the liquid therethrough. Thus, dispensing of the liquid is limited to passage through the dispenser, typically situated proximal an edge or side of the cover for convenient placement of the mouth or lips of the user thereupon for drinking the liquid. Unfortunately, such covers often allow spillage of the liquid through the dispenser, especially if the dispenser means has no closing means, such as an aperture cover, flap, or like for closing the dispenser is provided. Further, even when such closing means is present, it must often, inconveniently, be engaged and disengaged by the user's hand. Such is the case, for example, for conventional covers which have flaps extending over the dispensing aperture as the closing means, the flap being foldable back and forth between open and closed configurations to selectively uncover and recover the dispensing aperture. Obviously, such constraints can render closure and opening of the cover aperture by the user quite cumbersome, and even dangerous, when the liquid is a hot liquid and/or when user is engaged in other activities requiring use of the user's hands, for example driving.

Accordingly, there is a need for an improved liquid dispensing cover.

SUMMARY OF THE INVENTION

It is therefore a general object of the present invention to provide an improved liquid dispensing cover.

An advantage of the present invention is that the liquid dispensing cover impedes spillage of the liquid stored in the container.

Another advantage of the present invention is that the liquid stored in the container may be easily dispensed through the cover with a minimum risk of spillage.

A further advantage of the present invention is that the cover may be selectively opened to dispense the liquid and subsequently closed without use of the user's hands.

Still another advantage of the present invention is that the cover includes a dispensing recess for temporarily containing inadvertently spilled liquid and redirecting that liquid into the container.

Yet another advantage of the present invention is that the cover is made out of a single piece of material, preferably by plastic molding.

According to one aspect of the present invention, there is provided a liquid dispensing cover for a container for a liquid, the container having a container side wall with a generally circular open container top end, the container top end having an outwardly protruding container flange extending circumferentially therearound, the cover comprising:

a generally circular cover top wall having a downwardly facing annular peripheral groove extending around and defining a periphery thereof, the groove releasably, and sealingly receiving the container flange for releasably and sealingly connecting the cover top wall to the container top end; and a dispensing recess recessing downwardly from the cover top wall adjacent a portion of the peripheral groove, the dispensing recess having a recess bottom wall, downwardly inset from the cover top wall, and at least one recess protrusion extending upwardly from the recess bottom wall and vertically above the cover top wall, the recess bottom wail having a free edge extending adjacent and along said portion of said peripheral groove, said recess bottom wall being resiliently movable, by application of a downwardly directed force to the protrusion, between a closed configuration for the cover being constructed of a single piece of material, in which the recess bottom wall closes the dispensing recess, and an open configuration for the cover, in which the recess bottom wall is opened at the free edge, thereby enabling flow of the liquid therethrough;

the dispensing recess being formed by a proximal recess side wall extending adjacently proximal alongside the portion of the peripheral groove relative to the free edge, a distal recess side wall spaced radially inwardly apart from the proximal side wall and away from the groove portion relative to the free edge, and first and second end walls extending between and connecting to the distal and proximal recess side walls, the recess bottom wall being connected to the distal and proximal side walls and the recess end walls, the distal recess side wall partially forming the protrusion, the proximal and distal recess side walls and the recess end walls being substantially perpendicular to said cover top wall;

said free edge starting at a first intersection of said proximal recess side wall, said recess bottom wall, and said first recess end wall, and ending at a second intersection of said proximal recess side wall, said recess bottom wall, and said second recess end wall so as to entirely extend adjacent and along said proximal recess side wall;

said proximal recess side wall partially forming said groove, said recess bottom wall comprising a proximal wall portion extending adjacently proximal and from said proximal recess side wall and a distal wall portion extending adjacently proximal and from said distal recess side wall, said free edge extending on said distal wall portion;

said groove having a groove entrance with a radial width generally smaller than a radial thickness of the container flange so as to, when said cover is in said closed configuration, resiliently bias said proximal wall portion against said distal wall portion with said free edge extending underneath said proximal wall portion and in abutment therewith, thereby closing said dispensing recess, said distal wall portion being moved downwardly by said force when applied and separated thereby from said proximal wall portion, thereby enabling the liquid to flow between said proximal and distal wall portions and through the dispensing recess, said cover being placed thereby in said open configuration.

In another aspect, there is provided a liquid dispensing cover for a container for a liquid, the container having a closed container bottom end and an open container top end with a container side extending therebetween, the cover comprising:

a cover side wall sealingly mating with the container top end;

a cover top wall sealingly connected to the cover side wall and having a dispensing recess, recessing inwardly from the cover top wall on a recess side wall extending inwardly from the cover top wall, the dispensing recess having a resilient proximal portion proximal the cover side wall and a generally opposed distal portion distal the cover side wall, the dispensing recess having a recess protrusion extending outwardly therefrom, the proximal portion being movable between a closed configuration, in which the proximal portion abuts against the recess side wall of the dispensing recess to impede flow of the liquid therebetween, and an open configuration in which the proximal portion is separated from the recess side wall, thereby enabling flow of the liquid therebetween, by application of an inwardly directed force to the recess protrusion.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
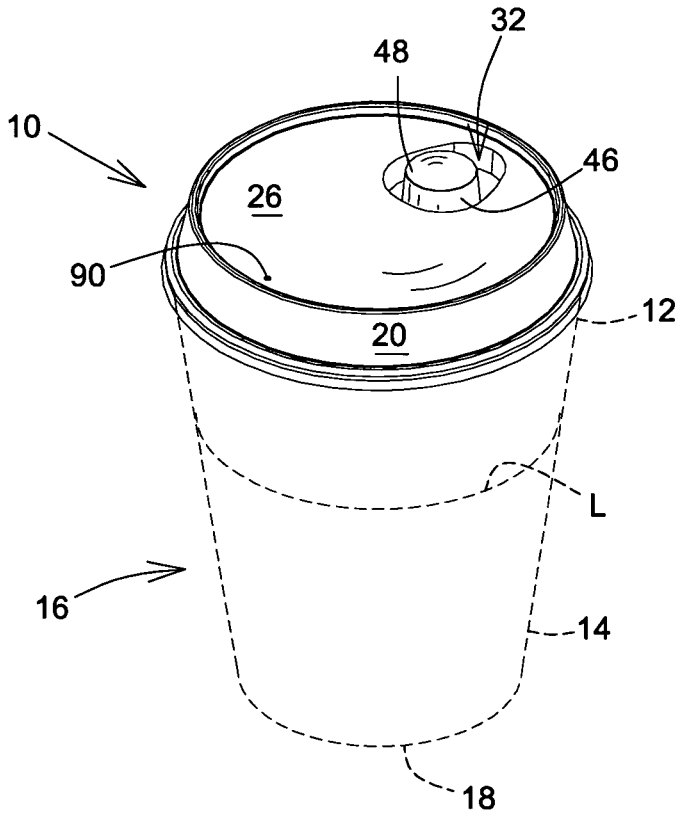
FIG. 1 is an exterior perspective view of a liquid dispensing cover, in accordance with a first embodiment of the present invention.
Figure 2:
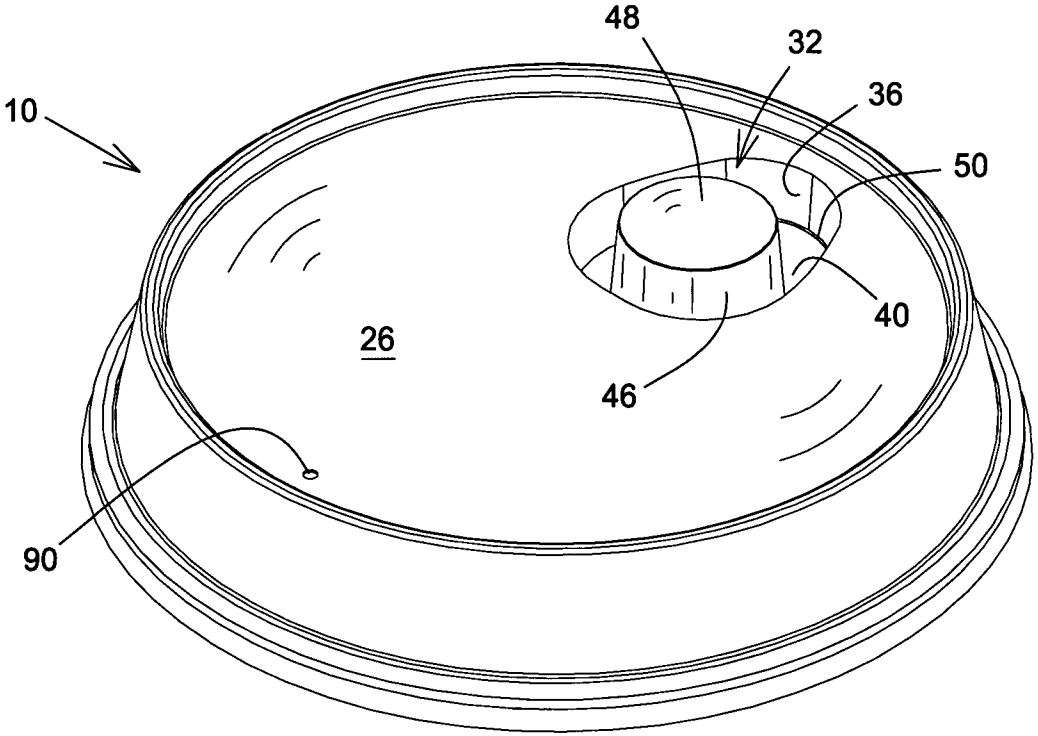
FIG. 2 is an enlarged exterior perspective view of the cover shown in FIG. 1.

Referring now to FIGS. 1 through 5, there is shown an embodiment of a liquid dispensing cover, shown generally as 10, in accordance with the present invention. As shown in FIG. 1, the cover 10 is configured for sealingly extending across a top end 12 of a conventional liquid container 16 in which a liquid L is stored. The container 16 has a container side 14 extending between the top end 12 and a generally opposed closed container bottom end 18.

Figure 3:
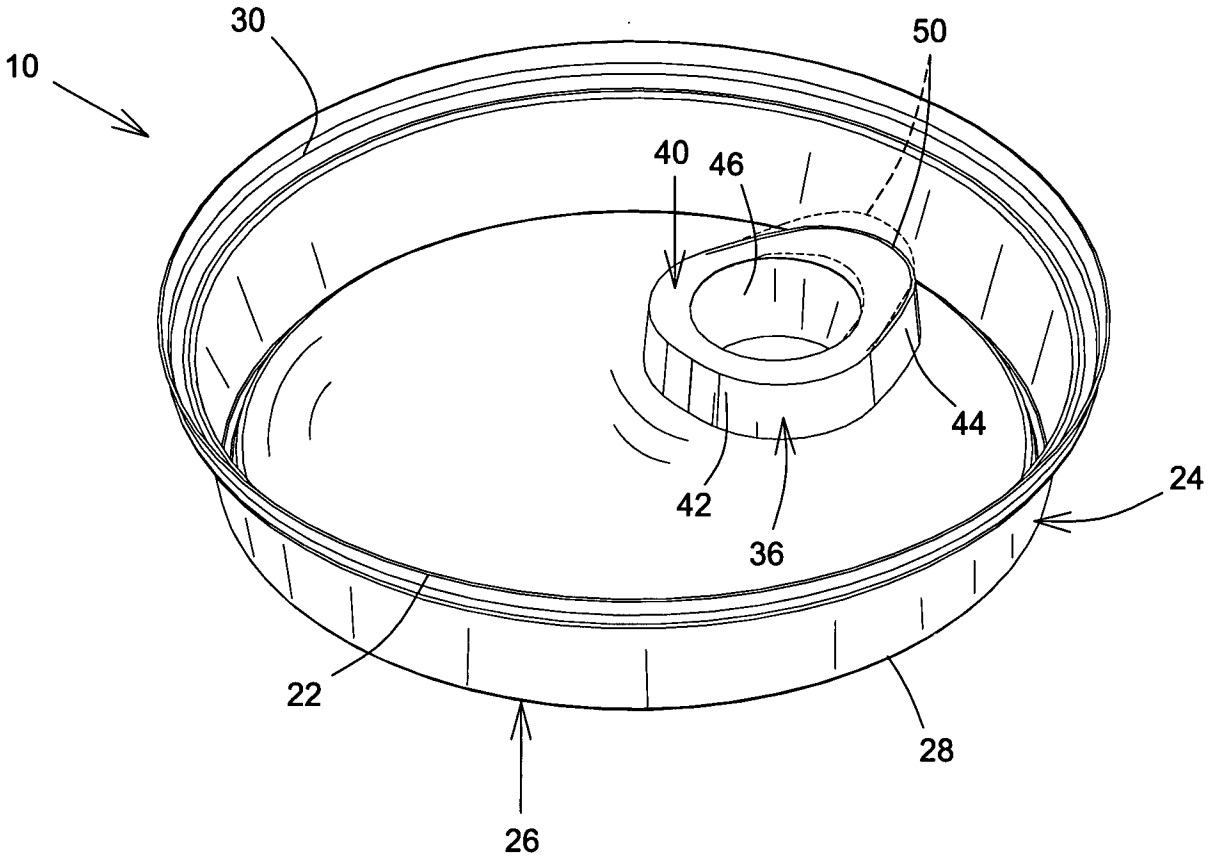
FIG. 3 is an interior perspective view of the cover shown in FIG. 1.
Figure 5:
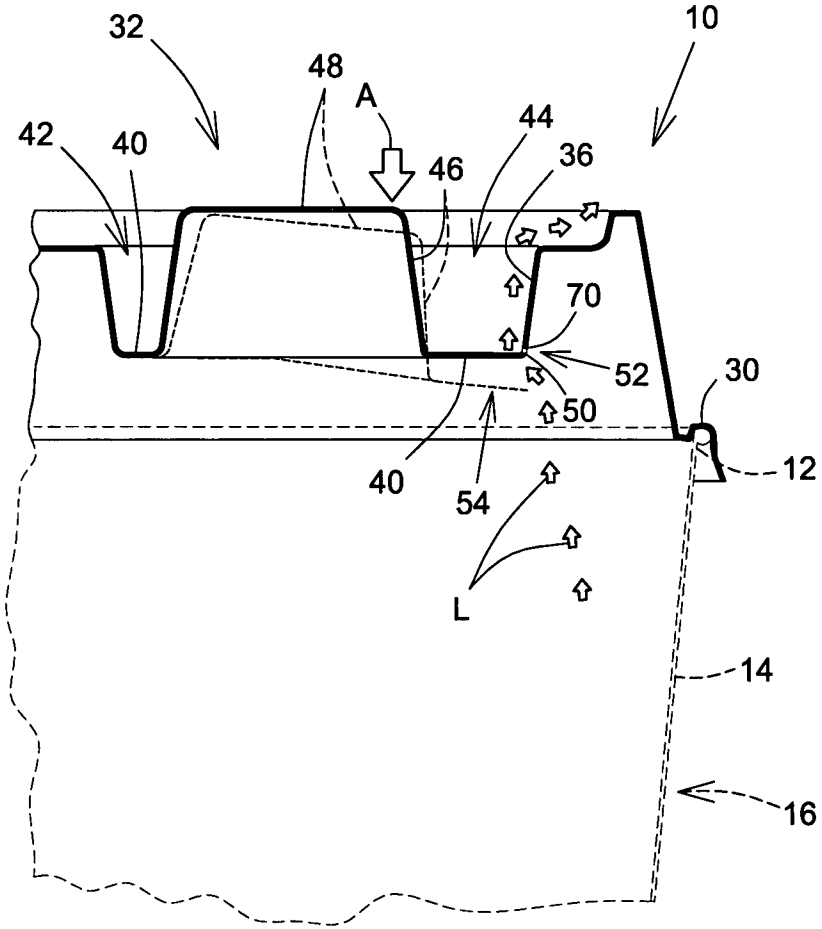
FIG. 5 is a sectional view of the cover shown in FIG. 1, taken along line 5-5 of FIG. 4 and illustrating open and closed configurations therefore.
Figure 4:
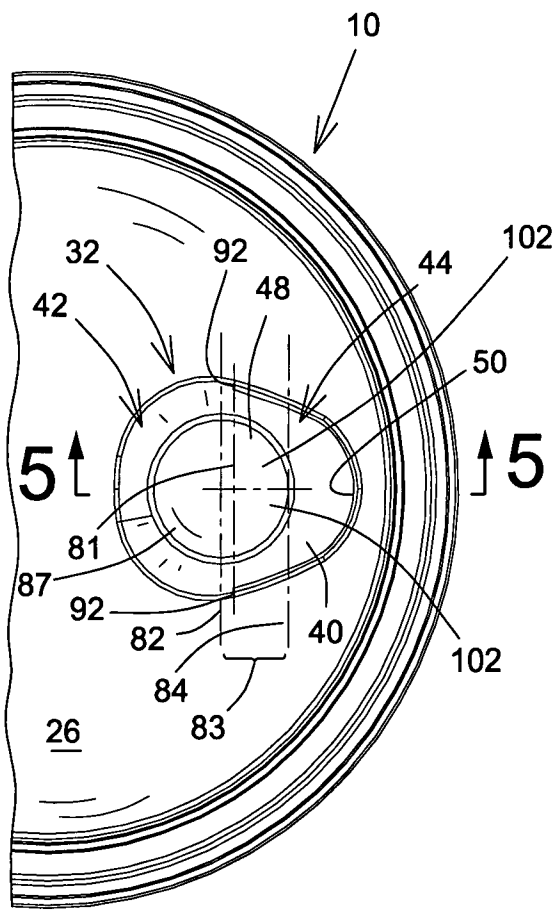
FIG. 4 is a bottom plan view of the interior of the cover shown in FIG. 1.

As shown in FIGS. 1, 3 and 5, the cover 10 has a cover side wall 20 having a connecting means 30, for example a groove, for sealingly connecting or mating the cover 10 to the top end 12 and a cover top wall 26 extending radially inwardly away from a top side end or edge 28 of the cover side wall 20. Thus, the cover side wall 20 is sealingly connected to the cover top wall 26, preferably proximal the top side end 28 of the side wall 20, and extends generally radially therefrom to a bottom side end 22, where the connecting means 30 is disposed. Accordingly, when the cover 10 is connected to the container 16, the cover 10 seals the container 16 at the container top end 12. A dispensing recess, shown generally as 32, of the top wall 26 may then be selectively moved between a closed configuration 52 and an open configuration 54 to allow liquid L to be dispensed from the container 16 through the cover 10.

Referring now to FIGS. 1 to 5, the dispensing recess 32 is formed by one or more recess side walls 36 that extend inwardly, i.e. towards the bottom side end 28, from the top wall 26, and a recess bottom wall 40, made of resilient material such as a resilient plastic, which extends betweens between the recess side walls 36. Thus, the dispensing recess 32 forms a spout or mouth 32 extending inwardly from the cover top wall 26 of the cover 10. The dispensing recess 32 has a first proximal portion or end 44, situated proximal the cover side wall 20, and a second distal portion or end 42 situated distal the cover side wall 20, both proximal and distal portions 44, 42 being preferably rounded or curved in shape. A recess protrusion 46, or button, preferably hollow and cylindrical in shape, extends outwardly from the recess bottom wall 40 towards the cover top wall 26, with a protrusion top 48 of the protrusion 46 being substantially level with the top wall 26 or extending vertically upwardly slightly therebeyond. The recess protrusion 46, spaced apart from the side wall 36, is disposed between the proximal and distal portions 44, 42 with a portion thereof extending into the distal portion 42 and a portion thereof extending into the proximal portion 44.

The recess bottom wall 40 is sealingly, yet resiliently, connected to the recess side wall 36 around the distal portion 42 and has a free edge 50, detached from the recess side wall 36, extending along the proximal portion 44. When the dispensing recess 32 is in a default closed configuration, shown generally as 52, the free edge 50 is resiliently biased against the side wall 36 and intersects therewith around the proximal portion 44. Thus, dispensing flow or spillage of the liquid L between the walls 36, 40 and out of the dispensing recess 32 is impeded. However, when an inwardly directed force, as shown by arrow A in FIG. 5, is applied to the dispensing recess 32, and in particular the proximal portion 44, the dispensing recess 32 is placed in an open configuration, shown generally as 54, in which the free edge 50 is separated from the recess side wall 36. Accordingly, when the dispensing recess 32 is in the open configuration 54 the liquid L may flow between the free edge 50 and the recess side wall 36 and thus be dispensed out of the dispensing recess 32. When the inwardly directed force is released, the free edge 50 is resiliently biased, by the recess bottom wall 40 at the distal portion 42, back into intersecting contact with the recess side wall 36, returning the dispensing recess 32 to the closed configuration 52.

Advantageously, as the free edge 50 extends along the proximal portion 44, when the dispensing recess 32 is in the open configuration 54, liquid L flowing out of the dispensing recess 32 must do so through the proximal portion 44. Thus, the liquid L is dispensed through the proximal portion 44 in proximity to the cover side wall 20, typically in proximity to a user's lips which facilitates drinking of the liquid L and reduces risk of spillage. To further facilitate pouring or flow of the liquid L through the proximal portion 44 when the dispensing recess 32 is in the open configuration 54, the recess side walls 36 and recess bottom wall 40 preferably taper inwardly from the distal portion 42 to the proximal portion 44. Conveniently, as the protrusion top 48 of the protrusion 46 is substantially level with the top surface 38 or extends slightly vertically therebeyond, and is situated proximal the cover side wall 20, a user can easily exert the inwardly directed force with his or her upper lip by placing the upper lip against the protrusion top 48 and tilting the container 16 and cover 10 towards his or her lips. Thus, the user may easily place the cover in the open configuration 54 when placing the cover 10 against his or lips and tipping the container 16 and cover 12 upwardly to drink from the container 16. Accordingly, the cover 10, and notably the dispensing recess 32, can be placed in the open configuration 54 by using a conventional drinking motion. Similarly, when the container 16 and cover 12 are tilted away from the upper lip, the upper lip is separated from the protrusion top 48. Thus, the inwardly directed force is released and the dispensing recess 32 is biased back into the closed configuration 52. Accordingly, the dispensing recess 32 may be moved between the closed and open configurations 52, 54 without manipulation of the dispensing recess 32 by the user's hands.

Preferably, but not compulsorily, the side recess walls 36 extend inwardly until they are substantially vertically aligned with or slightly above, along with the recess bottom wall 40, the bottom side end 22 or the top end 12 of the container 16. Thus, the container 16 may be fully filled with Liquid L without the Liquid L overflowing through the dispensing recess 32. Optionally, if desired, the free edge 50 may initially be breakably, and preferably sealingly, connected to the recess side wall 36, for example with a weak bonding agent or the like. Alternatively, the cover 10 could be fabricated such that the free edge 50 and cover side wall 36 are initially molded together at a thin, breakable intersection between edge 50 and wall 36, preferably a thinner or weakened breakable portion 70 of the recess side wall 36 which extends adjacently proximal the edge 50. By exerting the inwardly (downwardly) directed force on the free edge 50, however, the sealing connection between the free edge 50 and the recess side wall 36 can be broken along the breakable portion 70, thus allowing the dispensing recess 32 to be moved between the closed and open configurations 52, 54 as previously described. Until the sealing connection between the free edge 50 and cover side wall 36 is broken, however, the dispensing recess 32 would be completely sealed, preventing accidental spillage therefrom.

Advantageously, the round, cylindrical form of the recess protrusion 46, as well as its location extending on the recess bottom wall 40 through both the proximal and distal portions 44, 42, prevents the wall 40 at the proximal portion 44 from becoming permanently bent inwardly by repeated exertion of the inwardly directed force, thus maintaining the resiliency of the recessed portion 32, and notably the recess bottom wall 40 at the proximal portion 44, between the closed and open configurations 52, 54. To ensure that such resiliency is maintained, the movable edge 50 and breakable portion 70 must extend around recess side wall 36 and recess bottom wall 40 to opposing edge ends 92 that are aligned with, i.e. extend alongside, opposite faces or quadrants 102 of proximal cylindrical half 83 of the recess protrusion 46. More specifically, the proximal cylindrical half 83 is represented by the end of edge 50 at line 81, extending between lines 82 and 84, within region 83, situated proximal the distal portion 42 and cover side wall 20. The distal cylindrical half 87 is situated within the distal portion 42.

Advantageously a small air aperture 90 or slit, disposed in the top wall 26 proximal the cover side wall 20 but generally opposite the dispensing recess 32, allows for flow of air in and out of the container 16 through cover 10. The small size of the air aperture 90 or slit, as well as positioning thereof proximal the cover side wall 20 but generally opposite the dispensing recess 32, allows for the flow of air as the container 16 is tilted back and for the during use while impeding inadvertent flow of liquid through the aperture 90.

Figure 6:
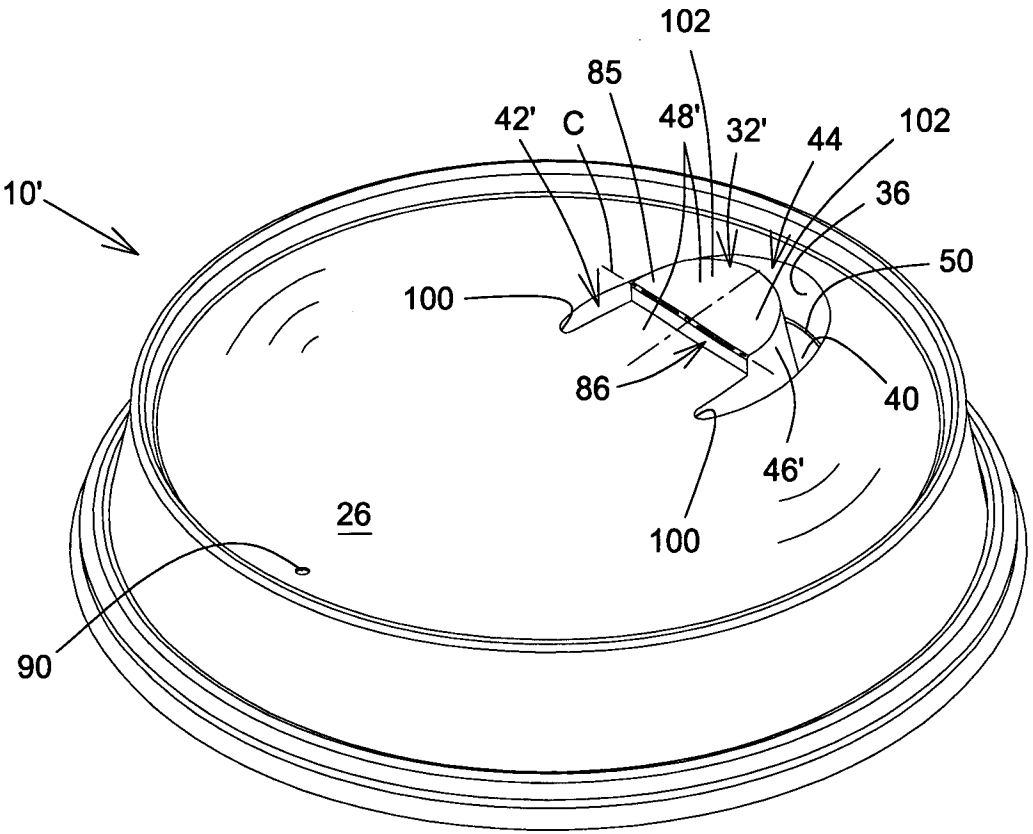
FIG. 6 is a perspective view of a liquid dispensing cover, in accordance with a second embodiment of the present invention.
Figure 7:
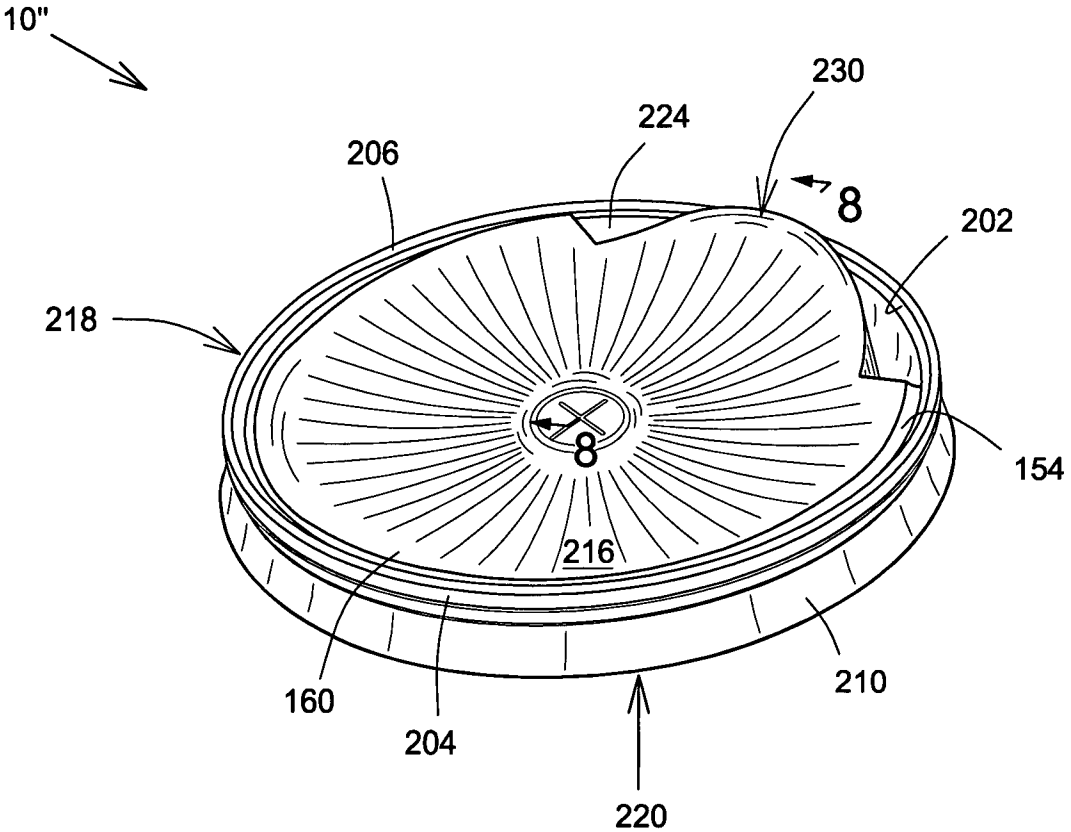
FIG. 7 is a perspective view of a liquid dispensing cover in accordance with a third embodiment of the present invention.

Referring now to FIG. 6, therein is shown an alternative, second embodiment of a cover 10' in accordance with the present invention. In all respects, with exception of the recess protrusion 46' and the distal portion 42' of the dispensing recess 32', the cover 10' is identical in form and function to the cover 10 shown in FIGS. 1 through 5. For cover 10', the recess protrusion 46' extends to, and forms part, of the distal portion 42' and cover top 26'. More specifically, the recess protrusion 46' extends upwardly from the bottom wall 40, but also intersects the side wall 36 and top surface 26 at intersection 100. Thus dispensing recess 32' forms an incomplete oval shape, with the recess protrusion 46' extending across the top surface 26 in distal portion 42' at intersection 100. The recess protrusion 46' extends from intersection 100 through the distal portion 42' to a semi-cylindrical portion 85 of the recess protrusion 46', which extends upwardly from the recess bottom wall 40 in the proximal end portion 44. The recess bottom wall 40 is connected to the recess side wall 36 and recess protrusion 46' from the intersection 100 until at least the semi-cylindrical portion 85. The free edge 50 or breakable portion 70 extends on the recess bottom wall 40, no further than the center C of the rounded portion 85. The semi-cylindrical shape of the semi-cylindrical portion 85, as well as the connection of the recess protrusion 46' at intersection 100 and the walls 40, 36 through the distal portion 42' provide the same resiliency for the recess portion 32, notably the free edge 50 or breakable portion 70, between configurations 52, 54 as for cover 10. To ensure such resiliency, as in 81 for cover 10, the movable edge 50 or breakable portion 70 must extend no further than the center C of the rounded portion 85. In other words, for cover 10', as for cover 10 shown in FIG. 5, the edge ends 92 must extend around the recess bottom wall 40 to portions thereof that are aligned with opposing quadrants 102. If desired, and as shown, the protrusion top 48' of protrusion 46' may be additionally or further protruded over the rounded portion 85, thus forming a rounded protruded lip or flange 86 relative the remainder of the protrusion top 48' and the cover top 26 to facilitate engagement with the user's upper lip to exert the inwardly directed force, as explained previously with regard to FIG. 5 and arrow A.

Referring now to FIGS. 7, 8, 8*a*, and 9, therein is shown a liquid dispensing cover, shown generally as 10", in accordance with a third embodiment of the present invention. Cover 10" has a cover top wall 216, generally circular in shape, with a downwardly facing or oriented peripheral groove 218 extending circumferentially around and defining the periphery of the cover top wall 216. Groove 218 of cover 10" is defined by inner groove wall 202 adjacent top wall 216, an outer groove wall 204 generally opposite inner groove wall 202, and a top groove wall 206 connecting the inner and outer groove walls 202, 204, with an optional apron 210 depending from an outer groove wall 204 of the groove. Groove 218 is configured, i.e. sized and shaped for sealingly and matingly, preferably snappably, receiving the outwardly protruding container flange 208 at the container top end 12 to provide releasable and sealable connection between cover 10" and the container 16. Cover top wall 216 extends radially inwardly away from groove 218. Accordingly, when the cover 10" is connected to the container 16, the cover 10" seals the container 16 at the container top end 12, notably at flange 208. The cover 10" is preferably made of a single piece of material, preferably a plastic material.

Cover 10" has an openable and closeable dispensing recess, shown generally as 224, recessing, i.e. depending, inwardly and downwardly from the cover top wall 216 and through which Liquid L may be dispensed from the container 16 through the cover 10". For cover 10", the dispensing recess 224 is defined by proximal recess side wall 212 and distal recess side wall 114, and resiliently openable and closable recess bottom wall 228. The proximal recess side wall 212 recesses radially inwardly, i.e. towards the bottom side end 220 of cover 10", from the inner groove wall 202 of adjacent portion of groove 218 extending between first and second recess end walls 110. The first and second recess end walls 110 also recess radially inwardly, from the cover top wall 216', and taper inwardly from the proximal recess side wall 212 to the distal recess side wall 114. As the proximal recess side wall 212 extends contiguously adjacent groove 218, it is curved and arcuate in shape. At the same time, distal recess side wall 114, distal the groove 218 and also extending radially inwardly relative the cover top wall 216, is also curved around a curbed, generally semi-circular arc, from the first recess end wall 110 to the second recess end wall 110, and is spaced inwardly from the proximal recess side wall 212. Thus, the dispensing recess 224 is generally curved and arcuate in shape and extends generally adjacent the inner groove wall 202 of groove 218. The distal recess side wall 114, along with the cover top wall 216 adjacent thereto and extending between the end walls 110 define a generally semicircular button or recess protrusion 230 extending into the dispensing recess 224 and upwardly from recess bottom wall 228.

Figure 9:
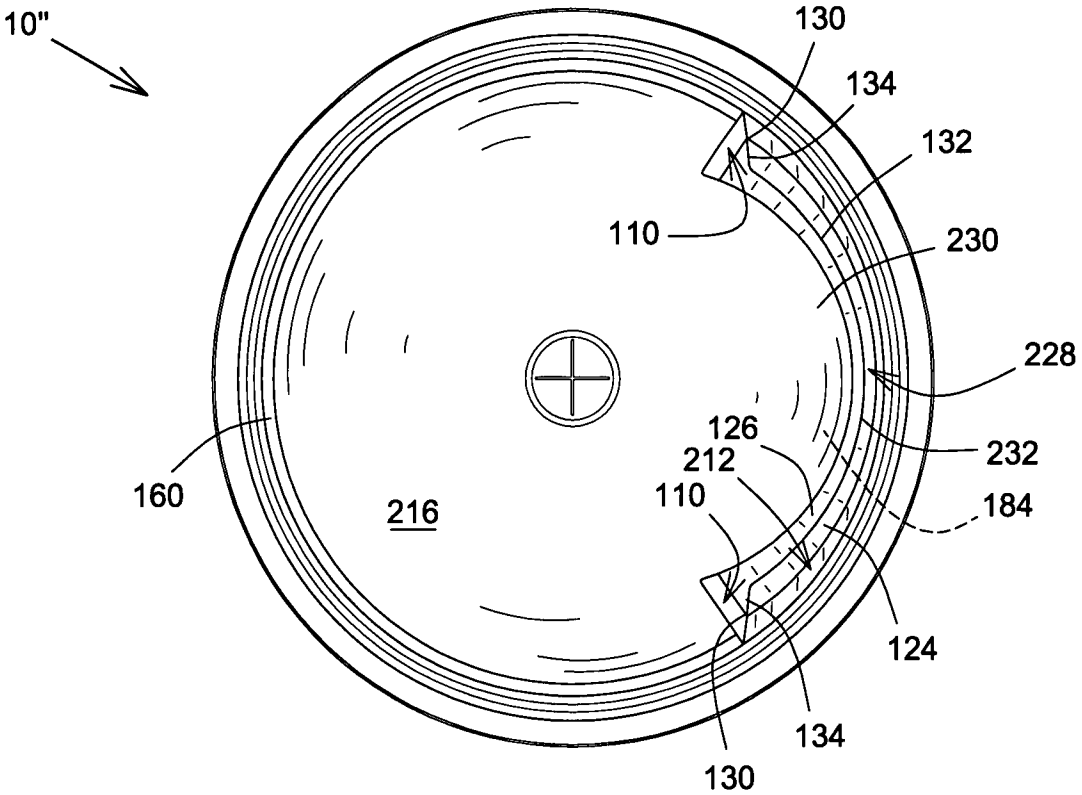
FIG. 9 is a top plan view of the liquid dispensing cover shown in FIG. 7.

The recess bottom wall 228 extends from, and between, the bottom of the recess end walls 110, the distal recess side wall 114, and the proximal recess side wall 212 to provide the openable and closeable bottom 228 of the dispensing recess 224. Thus, the recess bottom wall 228 is connected to cover top wall 216 by walls 114, 110, 212 and is inwardly inset thereby relative to the cover top wall 216. As best shown in FIG. 9, a break or slit 232 in the recess bottom wall 228 provides a resiliently movable edge 232 in the recess bottom wall 228 to provide a closeable opening 234 in the bottom wall 228 through which the liquid L may pass to dispense the liquid L through the dispensing recess 224. The movable edge 232 preferably curves along a curved edge portion 132 extending on bottom 228 between the proximal recess side wall 212 and distal recess side wall 114. The curved edge portion 132 preferably extends between and is connected to the proximal recess side wall 212, either directly or, preferably, by first and second edge end portions 134 of the edge 232. The edge end portions extend from the curved arc portion 132, preferably diagonally, to first and second intersections 130 between proximal recess side wall 212 and first and second recess end walls 110. Thus, the movable edge 232 defines, for the recess bottom wall 228 a proximal wall portion 124, adjacently proximal the proximal recess side wall 212, and a resiliently movable distal wall portion 126, distal the proximal recess side wall 212 and adjacently proximal the distal recess side wall 114 and protrusion 230.

Figure 8:
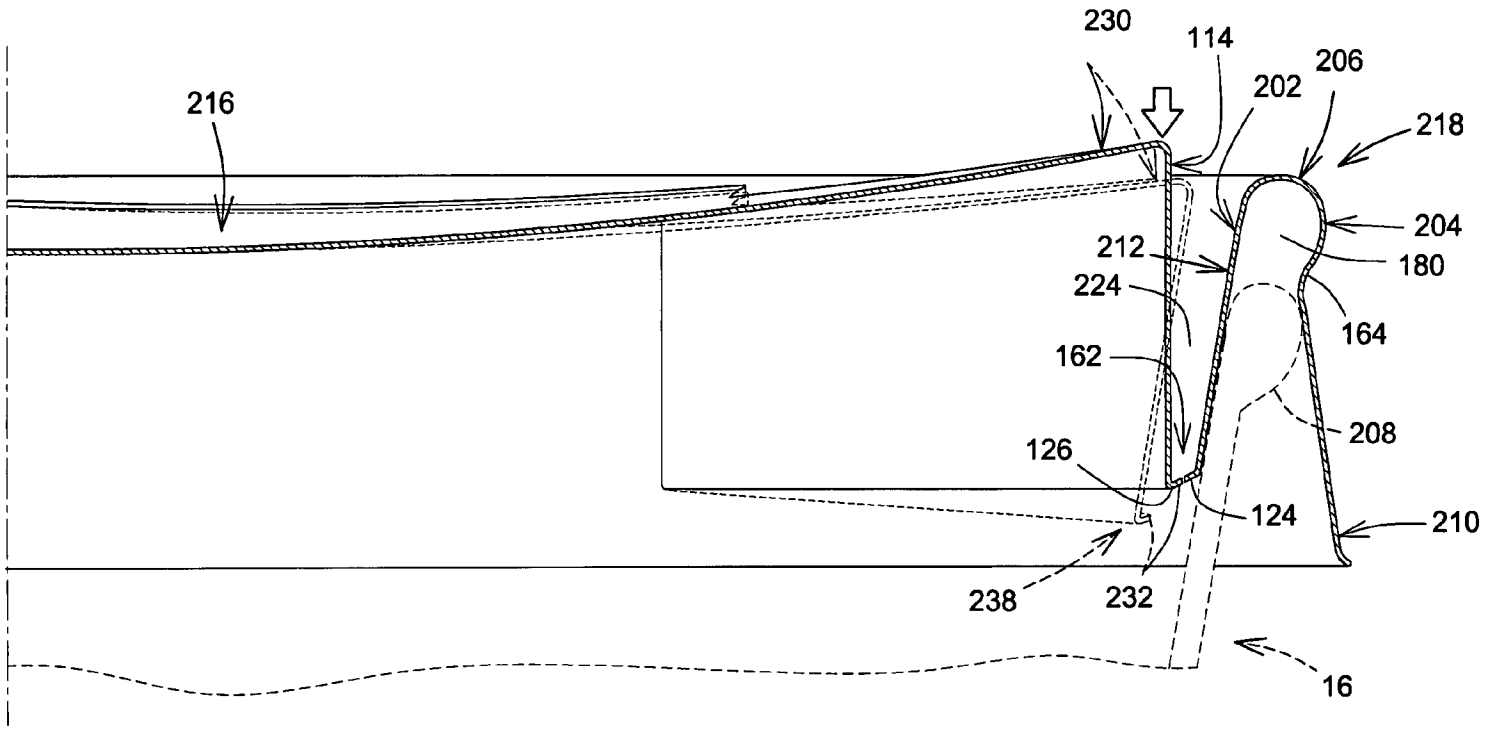
FIG. 8 is a sectional view of the liquid dispensing cover shown in FIG. 7, taken along line 8-8 of FIG. 7, showing a closed configuration.
Figure 8A:
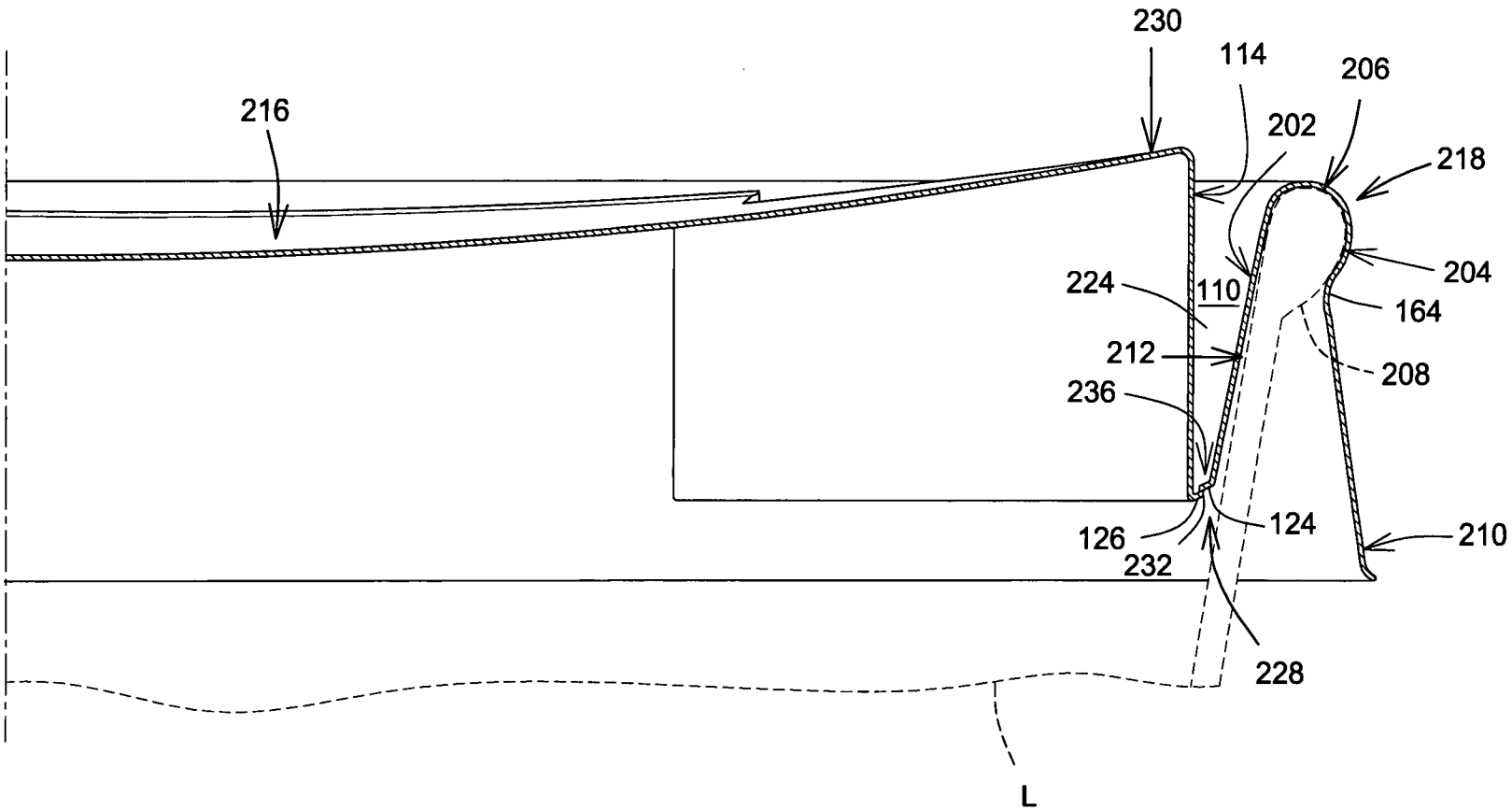
FIG. 8*a* is a sectional view of the liquid dispensing cover shown in FIG. 7, taken along line 8-8 of FIG. 7, showing an open configuration.

As shown in FIG. 8*a*, when the cover 10", notably the bottom wall 228, is in a closed configuration, shown generally as 236, on container 16, the distal wall portion 126 is resiliently biased underneath the proximal wall portion 124 and in abutment therewith, with the movable free edge 232 extending adjacently under the proximal wall portion 124. Thus, the recess bottom wall 228 closes the recess 224 and impedes dispensing flow or spillage of the liquid L from the dispensing recess 224, i.e. between the wall portions 124, 126. However, when an inwardly directed force, as shown by arrow A, is applied to the distal wall portion 126 of dispensing recess 212, notably to recess protrusion 230, the bottom wall 228, the cover 10", and notably bottom wall 228, is placed in an open configuration, shown generally as 238 in FIG. 8. In the open configuration 238, force A causes the distal wall portion 126 proximal the movable edge 232 to move downwardly and separate from the proximal wall portion 124. Thus, the recess bottom wall 228 is opened at the free edge 232, providing closeable opening 234. Accordingly, the liquid L may flow between the closeable opening 234 between the wall portions 124, 126 and through the dispensing recess 224 to be dispensed from the container 16 through recess 224. When the inwardly directed force A is released, the free edge 232 is resiliently biased, by the distal wall portion 126, recess end walls 110, and distal recess side wall 114, upwardly back into abutting contact with the proximal wall portion 124. Thus, when the force A is released, the cover 10" connected to container 16, and notably the bottom wall 228, is returned to the closed configuration 236. It should be noted that, alternatively, the movable free edge 232 could extend alongside and under the proximal side wall 212 and, in the absence of the inward force A, be resiliently biased into abutment therewith. In such case, the positioning of the movable free edge 232 for closed and open configurations 236, 238 for cover 10" would be similar to edge 50 for configurations 52, 54 for cover 10.

Referring to FIG. 8, the proximal wall portion 124 and distal wall portion 126 are further configured, i.e. sized and shaped, such that, in an initial configuration 162 for the cover 10", when the cover 10" is not connected to container 16, the wall portions 124,126 extend co-linearly with one another with the free edge 232 extending therebetween. In particular, for the initial configuration 162, the wall portions 124, 126 extend or slope upwardly in co-linear alignment with one another from the distal recess side wall 114 towards the proximal recess side wall 212. The outer groove wall 204 has an indented portion 164 indented inwardly towards inner groove wall 202 which forms the entrance opening 180 for the groove with the proximal recess side wall 212 around the dispensing recess 224. For the remainder of the cover 10", i.e. other than the dispensing recess 224, the entrance opening 180 is formed by the indented portion 164 and the inner groove wall 202.

The entrance opening 180 is of lesser thickness or width than the flange 208. The groove 218 is sized and shaped such that while the flange 208 is disposed in groove 218, for example when cover 10" is connected to container 16, the flange 208 and groove 218, in particular the indented portion 164, cause the inner groove wall 202 and proximal recess side wall 212 contiguously adjacent thereto to bias inwardly. The inward biasing of the proximal recess side wall 212 when the cover 10" is connected, along with the upward slanting of wall portions 124, 126, causes the proximal wall portion 124 to be biased upwardly and over the distal wall portion 126, with the distal wall portion 126 extending thereunder and in abutment therewith. Thus, when the cover 10" is connected to the container 16, the indented portion 164, groove 218, and flange 208, along with container side wall 14 cooperate to bias inner wall portion 234 inwardly and upwardly to move the cover 10" from the initial configuration 162 to the closed configuration 236. The cover 10" may then be moved between configurations 236, 238 as previously described. When the cover 10" is removed from the container 16, the proximal wall portion 124 is no longer biased upwardly and inwardly, and the cover 10" returns to the initial configuration 162.

The cover top wall 216 and distal recess side wall 114 slope upwardly, beyond the vertical level of the top groove wall 206 of groove 218, between the recess end walls 110, in particular between the intersections with distal recess side wall 114 and recess end walls 110. Thus, the recess protrusion 230 slopes upwardly away from the rest of the cover top wall 216 with at least a portion of the protrusion 230, preferably adjacent the distal recess side wall 114 and end walls 110, extending vertically beyond the top groove wall 206. Therefore, the user can easily exert the inwardly directed force A, to place the cover 10" in the open configuration 238, with his or her upper lip by placing the upper lip against the protrusion 230 and tilting the container 16 and cover 10" upwardly in a conventional drinking motion. Similarly, when the container 16 and cover 10" are tilted away from the upper lip, the upper lip is separated from the protrusion 230. The inwardly directed force A is therefore released and the recess bottom wall 228 is biased back into the closed configuration 236. Accordingly, the cover 10" may be moved between the closed and open configurations 236, 238 without manipulation of the dispensing recess 224 by the user's hands. Advantageously, as the dispensing recess 224 and protrusion 230 are proximal the groove 218 and perimeter of cover 10", when the cover 10" is in open configuration 238, the liquid L is dispensed through the dispensing recess 224 in proximity to a user's lips.

An optional, but preferable, depression 154 in the cover top wall 216, extends circumferentially around the perimeter thereof adjacent inner groove wall 202, and the groove 218, with the exception of the dispensing recess 224. The depression 154 provides a trough 154 into which liquid L on the cover top 216 may drain into the dispensing recess 224. Optionally, the cover top wall 216 may slope upwardly commencing from distal top end 160 thereof, generally opposite recess 224, towards dispensing recess 224, with the cover top wall 216 at distal top end 160 situated vertically below the inner groove wall 202. Thus, liquid L on the cover top wall 216 may drain towards the distal top end 160 and into trough 154 and then from trough 154 to the dispensing recess 224. Alternatively, the cover top wall 216 may be shaped to curve downwardly from groove 218, depression 154, and protrusion 230 towards the center of cover top wall 216.

Optionally, if desired, the distal wall portion 126 may initially be breakably, and preferably sealingly, to the proximal wall portion 124 along edge 232, for example with a weak bonding agent or the like. Alternatively, the cover 10" could be fabricated such that the proximal and distal wall portions 124, 126 are initially molded together at a thinner or otherwise weakened breakable intersection defining edge 232. However, by exerting the inwardly directed force A on bottom wall 228, and notably the distal wall portion 126, for example with the protrusion 230, the sealing connection between the wall portions 124, 126 can be broken along the edge 232. Alternatively, the sealing connection could be broken by inward and upward biasing of inner wall portion 124 when the cover 10" is connected to container 16, as described previously.

The resilient biasing of the distal wall portion 126 from the closed configuration 236 to the open configuration 238 is provided by the round, preferably semi-circular shape of the distal recess side wall 114 and recess protrusion 230, along with the recess end walls 110, which slant downwardly and outwardly from the cover top wall 216 towards proximal recess side wall 212. In particular, to ensure that distal wall portion 126 does not become permanently bent inwardly by repeated exertion of the inwardly directed force A, the movable edge 232 must extend around distal wall portion 126 to opposing faces or quadrants of distal recess side wall 114.

The container 16 may be any type of conventional liquid container 16, such as a glass or cup, provided it provides a round opening at top end 12 and, for cover 10", flange 208. Further, the container 16, while preferably made of paper or styrofoam, may be constructed of any material, including plastics, glass, or the like, typically used for such containers 16. The cover 10, 10', 10", while preferably, made of plastic or polyurethane, may be made of other materials conventionally used for covers for liquid containers 16.

Although the present cover has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A liquid dispensing cover for a container for a liquid, the container having a container side wall with a generally circular open container top end, the container top end having an outwardly protruding container flange extending circumferentially therearound, said cover comprising:

a generally circular cover top wall having a downwardly facing annular peripheral groove extending around and defining a periphery thereof, said groove releasably and sealingly receiving the container flange for releasably and sealingly connecting said cover top wall to the container top end; and a dispensing recess recessing downwardly from said cover top wall adjacent a portion of said peripheral groove, said dispensing recess having a recess bottom wall, downwardly inset from said cover top wall, and at least one recess protrusion extending upwardly from said recess bottom wall and vertically above said cover top wall, said recess bottom wall having a free edge extending adjacent and along said portion of said peripheral groove, said recess bottom wall being resiliently movable, by application of a downwardly directed force to said protrusion, between a closed configuration for said cover being constructed of a single piece of material, in which said recess bottom wall closes said dispensing recess, and an open configuration for said cover, in which said recess bottom wall is opened at said free edge, thereby enabling flow of said liquid therethrough;

said dispensing recess being formed by a proximal recess side wall extending adjacently proximal alongside said portion of said peripheral groove relative to said free edge, a distal recess side wall spaced radially inwardly apart from said proximal side wall and away from said groove portion relative to said free edge, and first and second end walls extending between and connecting to said distal and proximal recess side walls, said recess bottom wall being connected to said distal and proximal side walls and said recess end walls, said distal recess side wall partially forming said protrusion, said proximal and distal recess side walls and said recess end walls being substantially perpendicular to said cover top wall;

said free edge starting at a first intersection of said proximal recess side wall, said recess bottom wall, and said first recess end wall, and ending at a second intersection of said proximal recess side wall, said recess bottom wall, and said second recess end wall so as to entirely extend adjacent and along said proximal recess side wall;

said proximal recess side wall partially forming said groove, said recess bottom wall comprising a proximal wall portion extending adjacently proximal and from said proximal recess side wall and a distal wall portion extending adjacently proximal and from said distal recess side wall, said free edge extending on said distal wall portion;

said groove having a groove entrance with a radial width generally smaller than a radial thickness of the container flange so as to, when said cover is in said closed configuration, resiliently bias said proximal wall portion against said distal wall portion with said free edge extending underneath said proximal wall portion and in abutment therewith, thereby closing said dispensing recess, said distal wall portion being moved downwardly by said force when applied and separated thereby from said proximal wall portion, thereby enabling the liquid to flow between said proximal and distal wall portions and through the dispensing recess, said cover being placed thereby in said open configuration.

2. The cover of claim 1, wherein said cover is constructed of a plastic material.

3. The cover of claim 1, wherein said distal recess side wall is curved radially outwardly along an arc between said first recess end wall and said second recess end wall.

4. The cover of claim 3, wherein said cover top wall slopes upwardly in an outwardly radial direction between said recess end walls to form said recess protrusion.

5. The cover of claim 1, wherein said recess end walls are slanted outwardly towards said proximal recess side wall from said cover top wall to said recess bottom wall.

6. The cover of claim 1, wherein said free edge comprises first and second edge end portions and a curved edge portion extending from said first edge end portion to said second edge end portion between said proximal and said distal recess side walls, said first edge end portion and said second edge end portion extending from said curved edge portion to, respectively, said first and second intersections.

7. The cover of claim 1, wherein said groove is formed by an inner groove wall extending circumferentially around said perimeter, an outer groove wall spaced apart from said inner groove wail, and a top groove wall connecting said inner and outer groove walls, said proximal recess side wall extending contiguously to said inner groove wall.

8. The cover of claim 7, wherein said recess bottom wall slants upwardly from said distal recess side wall towards said proximal recess side wall.

9. The cover of claim 8, wherein said proximal and said distal wall portions are collinearly aligned with one another when said container flange is not disposed within said groove.

10. The cover of claim 7, wherein said outer groove wall has an indented portion indented inwardly towards said inner groove wall, said indented portion, in cooperation with the container flange, biasing said proximal recess side wall and said proximal wall portion inwardly while said cover is connected to said container to bias said proximal wall portion upwardly over said distal wall portion with the free edge in abutment therewith, thereby placing said cover in the closed configuration.

* * * * *